US009566643B2

(12) United States Patent
Brandt

(10) Patent No.: US 9,566,643 B2
(45) Date of Patent: Feb. 14, 2017

(54) METHOD OF CASTING LITHIUM CONTAINING ALUMINIUM ALLOYS

(71) Applicant: ALERIS ROLLED PRODUCTS GERMANY GMBH, Koblenz (DE)

(72) Inventor: Fred Brandt, Neuwied (DE)

(73) Assignee: ALERIS ROLLED PRODUCTS GERMANY GMBH, Koblenz (DE)

( * ) Notice: Subject to any disclaimer, the term of this patent is extended or adjusted under 35 U.S.C. 154(b) by 10 days.

(21) Appl. No.: 14/782,097

(22) PCT Filed: Mar. 11, 2014

(86) PCT No.: PCT/EP2014/054618

§ 371 (c)(1),
(2) Date: Oct. 2, 2015

(87) PCT Pub. No.: WO2014/166683

PCT Pub. Date: Oct. 16, 2014

(65) Prior Publication Data

US 2016/0038997 A1 Feb. 11, 2016

(30) Foreign Application Priority Data

Apr. 11, 2013 (EP) ..... 13163369

(51) Int. Cl.

| | |
|---|---|
| ***B22D 7/00*** | (2006.01) |
| ***B22D 7/02*** | (2006.01) |
| ***B22D 11/10*** | (2006.01) |
| ***B22D 21/04*** | (2006.01) |
| ***C22C 1/02*** | (2006.01) |
| ***C22C 21/00*** | (2006.01) |
| ***B22D 1/00*** | (2006.01) |
| ***B22D 11/041*** | (2006.01) |
| ***B22D 11/08*** | (2006.01) |
| ***B22D 11/119*** | (2006.01) |
| ***B22D 21/00*** | (2006.01) |
| ***B22D 37/00*** | (2006.01) |

(52) U.S. Cl.

CPC ..... *B22D 7/005* (2013.01); *B22D 1/00* (2013.01); *B22D 7/02* (2013.01); *B22D 11/041* (2013.01); *B22D 11/086* (2013.01); *B22D 11/10* (2013.01); *B22D 11/119* (2013.01); *B22D 21/007* (2013.01); *B22D 21/04* (2013.01); *B22D 37/00* (2013.01); *C22C 1/026* (2013.01); *C22C 21/00* (2013.01)

(58) Field of Classification Search

CPC ..... B22D 1/00; B22D 7/005; B22D 7/02; B22D 21/007; B22D 21/04; B22D 11/003; B22D 11/041; B22D 11/086; B22D 11/10; B22D 11/119; B22D 37/00

USPC ... 164/55.1, 57.1, 94, 95, 96, 460, 471, 473, 164/475, 487

See application file for complete search history.

(56) References Cited

U.S. PATENT DOCUMENTS

| | | | | |
|---|---|---|---|---|
| 4,582,118 | A | 4/1986 | Jacoby et al. | |
| 5,415,220 | A | 5/1995 | Edwards | |
| 7,938,165 | B2 * | 5/2011 | Lequeu et al. | B21C 33/004 164/461 |
| 2007/0259200 | A1 | 11/2007 | Lequeu et al. | |

FOREIGN PATENT DOCUMENTS

| | | | |
|---|---|---|---|
| CN | 101330995 | A | 12/2008 |

OTHER PUBLICATIONS

Chakravorty C.R. et al, "Melting and Casting Characteristics of Aluminium-Lithium Alloys", Proceedings IEEE Workshop on Interactive Voice Technology for Telecommunications Applications, XX, XX, vol. 2, No. 4, 1 (Jan. 1, 1990) , pp. 182-191, XP000579349.

International Search Report and the Written Opinion mailed May 26, 2014 for International Patent Application No. PCT/EP2014/054618 to Aleris Rolled Products Germany GmbH having an International filed of Mar. 11, 2014.

Registration Record Series Teal Sheets, International Alloy Designations and Chemical Composition Limits for Wrought Aluminum and Wrought Aluminum Alloys, The Aluminum Association, Inc., Revised Jan. 2015, Supersedes: Feb. 2009 (2015).

Registration Record Series Teal Sheets, International Alloy Designations and Chemical Composition Limits for Wrought Aluminum and Wrought Aluminum Alloys, The Aluminum Association, Inc., Revised Feb. 2009, Supersedes: Apr. 2006 (2009).

* cited by examiner

*Primary Examiner* — Kevin P Kerns

(74) *Attorney, Agent, or Firm* — Vorys, Sater, Seymour and Pease LLP

(57) ABSTRACT

Method of casting aluminum alloy ingot including lithium, including: preparing at least two molten aluminum based alloys in separate furnaces, first alloy with composition A free from lithium as purposive alloying element, and second alloy with composition B including lithium as purposive alloying element; transferring the first alloy via metal conveying trough from the furnace to a casting station; initiating casting an ingot and casting the first alloy to required length L1 in the casting direction; subsequently transferring the second alloy via metal conveying trough from the furnace to the casting station while simultaneously stopping transfer of the first alloy to the casting station; casting the second alloy from an end surface of the cast first alloy at length L1 to an additional required length L2 in the casting direction; cropping the cast ingot at a bottom thereof at a length greater than of equal to cast length L1.

15 Claims, No Drawings

METHOD OF CASTING LITHIUM CONTAINING ALUMINIUM ALLOYS

CROSS-REFERENCE TO RELATED APPLICATIONS

This is a §371 National Stage Application of International Application No. PCT/EP2014/054618 filed on Mar. 11, 2014, claiming the priority of European Patent Application No. 13163369.5 filed on Apr. 11, 2013.

FIELD OF THE INVENTION

The invention relates to a method of casting of aluminium-lithium alloys into feedstock suitable for further processing by means of extrusion, forging and/or rolling.

BACKGROUND TO THE INVENTION

As will be appreciated herein below, except as otherwise indicated, aluminium alloy designations and temper designations refer to the Aluminium Association designations in Aluminium Standards and Data and the Registration Records, as published by the Aluminium Association in 2013 and are well known to the person skilled in the art.

For any description of aluminium alloy compositions or preferred aluminium alloy compositions, all references to percentages are by weight percent unless otherwise indicated.

Aluminium alloys comprising lithium are very beneficial for use in the aerospace industry since the purposive addition of lithium may reduce the density of the aluminium alloy by about 3% and increase the modulus of elasticity by about 6% for each weight percent of lithium added. In order for these alloys to be selected in airplanes, their performance with respect to other engineering properties must be as good as that of commonly used alloys, in particular in terms of the compromise between the static mechanical strength properties and the damage tolerance properties. Over time a wide range of aluminium-lithium alloys have been developed with a corresponding wide range of thermo-mechanical processing routes. However, a key processing route remains the casting of ingots or billets for further processing by means of extrusion, forging and/or rolling. The casting process has proven to remain a problematic processing step in the industrial scale production of ingots and billets. There are amongst others issues with regard to oxidation of molten metal in the furnaces, the transfer troughs and during casting itself. And also safety issues remain as "bleed outs" or "runs outs" during casting of aluminium-lithium alloys can lead to much more violent reactions than with non-lithium containing alloys as lithium makes the molten aluminium much more reactive.

U.S. Pat. No. 5,415,220 issued to Reynolds Metals Company discloses a method of direct chill casting of aluminium-lithium alloys under a salt cover to protect the molten metal from oxidation by ambient oxygen, which comprises (a) forming a protective molten salt cover comprising a lithium chloride salt composition in a furnace containing molten aluminium alloy, (b) adding at least one of lithium and a lithium-containing aluminium alloy to the molten aluminium alloy through the salt cover to form a molten aluminium lithium alloy in the furnace, (c) transferring said molten aluminium-lithium alloy to a casting station, and (d) direct chill casting said molten aluminium-lithium alloy into an ingot form such as a billet or a rolling ingot. The molten metal transfer trough may include a metal filter, e.g. a foam filter or a ceramic bed filter designed for both particulate removal and degassing of the molten metal passing through the transfer trough. The molten salt cover is said to be particularly useful in direct chill casting processes wherein a salt cover is added to the ingot head in the mould. The salt mixture includes LiCl, and preferred salt mixtures include LiCl in combination with other salts selected from KCl, NaCl, and LiF. Sodium chloride is less preferred in the melting vessel since the sodium component thereof has a tendency to exchange with the lithium in the aluminium alloy, thereby adversely affecting the alloy content with sodium as a highly undesirable impurity element therein.

The use of salts, or salt mixtures, in the casting of lithium containing aluminium alloys has several disadvantages. An important disadvantage is that the salts are very corrosive for the often applied ceramic foam filters ("CFF") for removing of any particulate in the molten metal.

DESCRIPTION OF THE INVENTION

It is an object of the invention to provide a method of casting aluminium-lithium alloys into ingots or billets avoiding several of the problems associated with the salts, or at least to provide an alternative method of casting aluminium-lithium alloys.

This and other objects and further advantages are met or exceeded by the present invention and providing a method of casting an ingot of an aluminium alloy comprising lithium, the ingot having a length L direction, width W, and thickness T, the method comprising the steps of:

(a) preparing at least two molten aluminium based alloys in separate furnaces, a first alloy with a composition A which is free from lithium as purposive alloying element, and a second alloy with a composition B which comprises lithium as purposive alloying element and which preferably by maintaining a protective salt cover on the second alloy in the respective furnace;

(b) transferring the first alloy via a metal conveying trough from the furnace to a casting station;

(c) initiate the start of casting an ingot and casting the first alloy to a required length L1 of an ingot in the casting direction;

(d) subsequently transferring the second alloy via a metal conveying trough from the furnace to the casting station while simultaneously stopping the transfer of the first alloy to said casting station, and whereby preferably a transition between alloys A and B is obtained with no interruption to molten metal flow;

(e) casting the second alloy from an end surface of the cast first alloy at length L1 to an additional required length L2 in the casting direction; and (f) cropping, e.g. by means of sawing in case of a thick gauge ingot or by shearing, the cast ingot at a bottom thereof at a length that is greater than of equal to the cast length L1.

In accordance with the present invention the casting process is being initiated with an aluminium alloy free from lithium as purposive alloying element and once a stable casting condition or casting situation has been obtained, the continuous casting process is continued by transferring to the lithium containing aluminium alloy. This achieves the effect that the start of the casting process is without a lithium containing alloy and avoids the disadvantages associated with that. For example, otherwise if directly starting with the lithium containing alloy, prior to the start of the casting process the mould and the starter block are commonly coated, e.g. by means of spraying, with a salt flux, which are very hydroscopic. If not properly dried in advance, moisture originating from the salt may react with the molten aluminium-lithium alloy upon pouring into the casting mould and creating highly unsafe environment. At the start of the cast the molten aluminium poured onto the starter block shrinks at solidification, which may lead to water vapour used for cooling the casting mould entering the area in the mould potentially leading to explosions when in contact with the molten aluminium-lithium alloy. Furthermore, due to a higher viscosity aluminium-lithium alloys may give raise to problems at the beginning with the metal distribution system in the casting mould, e.g. made from fibreglass fabric line for example combo-bags, and as a consequence to an uneven metal distribution these alloys are prone to have bleed-outs at the start of the casting process. Bleed-outs in case of aluminium-lithium alloys may have catastrophic effects when the molten aluminium comes into contact with any cooling water. All these disadvantages and risks are overcome or at least significantly reduced in the method according to this invention as there is neither molten Al—Li alloy nor a need to any use of salts to reduce the oxidation by ambient oxygen at the start of the casting process.

At the end of the casting process once the ingot has been solidified, the cast ingot is removed from the casting station, thereafter the bottom of the ingot is being cropped from the ingot. Depending on the alloys cast this can be done after the cast or firstly after a heat treatment, and which could also be a homogenization heat treatment, to stress relieve the cast ingot. Although not desirable, but it is possible that in the transition from alloy A to alloy B a transition zone Z is formed having a composition intermediate between the first and second alloy. Ideally also this transition zone Z should be cropped from the cast ingot.

Where in the context of this invention reference is made to an ingot, it will be understood by the skilled person that this relates both to a rolling ingot having a length L and commonly forming the rolling direction, a width W and a thickness T, as well as to billet that can be used for extrusion or forging and having a length L, commonly forming the direction of extrusion, and having a substantially round periphery such that the width and thickness are the same dimension forming the diameter of the billet.

The present invention applies to various casting processes and preferably to a casting process chosen from direct chill casting, horizontal casting, continuous casting of strips between cylinders, and continuous casting of strips using a belt caster.

The process known to one skilled in the art as "direct chill casting" or "DC casting" is a preferred process within the context of this invention. In such a process, an aluminium alloy is cast in a water-cooled ingot mould with a dummy bottom or starter block while moving the dummy bottom vertically and continuously so as to maintain a substantially constant level of molten metal in the mould during solidification of the alloy, the solidified faces being directly cooled with water. The vertical casting direction forms the length direction of the subsequent cast ingot.

The method according to the invention aims at starting or initiating the casting process, in particular the DC casting process, using a lithium free alloy. Once a stable casting situation has been established the transfer of the first aluminium alloy can be replaced by the lithium containing second alloy. To that effect in an embodiment of the invention the cast length L1 is less than about three times the thickness T of the cast ingot, preferably L1 is less than about 2.5 times the thickness T of the ingot, and more preferably L1 is less than about two times the thickness T of the ingot.

In an embodiment the cast length L1+L2 is equal to the length L of the cast ingot.

In an embodiment the metal conveying trough comprises at least one housing for a metal filter, preferably a ceramic foam filter, for in-line melt treatment for the removal of non-metallic inclusions. It is known that the salt cover used in the furnaces for melting of lithium containing aluminium alloys and which is inevitable carried over from the melting furnace into the metal conveying trough, has a very detrimental effect on ceramic foam filters. This because the salts commonly applied are very corrosive to the ceramic filter. However, in the method according to the invention in-line metal treatment using ceramic filters to remove non-metallic inclusions does not cause any problems and can advantageously be applied. As the casting process is initiated with a first aluminium alloy free from lithium, there is also no corresponding need to apply a salt cover in the melting furnace. Consequently, no salt from the melting furnace salt cover is moved or transferred into the metal conveying trough. The in-line ceramic filter system will be filled with lithium-free aluminium alloy which is further transferred to the casting station. Once during the casting process there is the transition to the transfer to the second aluminium alloy, the molten metal level in the on-line ceramic filter system is kept sufficiently high to avoid that any salt transferred from the melting furnace with the second alloy comes into contact with the ceramic filter while the molten second aluminium alloy transfers through the ceramic filter to the casting station.

In an embodiment the metal conveying trough comprising a container for a metal degassing unit using a gas in particular for in-line reducing the hydrogen content and particulate removal from the molten aluminium alloy. The gas may be introduced with either a spinning nozzle degasser or flux wand.

In an embodiment of the method according to this invention also for the end of the casting process an aluminium alloy is used that is free from lithium as purposive alloying element. At that stage in the casting process the metal conveying trough and any ancillary equipment such as in-line ceramic filters and degassing units are flushed with an aluminium alloy free from lithium and subsequently can be put on stand-by filled with a lithium-free alloy and be available for a next cast and thereby expanding on their service life of this equipment.

Preferably the same first alloy A is being used, depending on its availability, but it can be also another aluminium alloy that is free from lithium. Thus the method comprises a further step such that following casting length L2 in the casting direction of the second alloy, subsequently transferring the first alloy via the metal conveying trough from the furnace to the casting station while simultaneously stopping the transfer of the second alloy to said casting station, and casting the first alloy from an end surface of the second alloy at length L2 to an additional required length L3 in the casting direction and subsequently finish the casting operation. The required length L3 is less critical for the casting process than the length L1. The latter should establish a safe and stable start of the casting process. Ideally the length L3 can be less than the thickness T of the cast ingot.

Also in this embodiment there will be cropping of the cast ingot at a head part or end part thereof at a length that is greater than of equal to the cast length L3. Also in this embodiment it is possible that in the transition from alloy B to alloy A a transition zone is formed having a composition intermediate between the first and second alloy. Ideally also this transition zone, if any, should be cropped from the cast ingot.

In an embodiment the first aluminium alloy has a composition A comprising less than 0.1% of lithium, preferably less than 0.02%, and more preferably is substantially lithium free. The term "substantially free" means having no significant amount of that component purposely added to the alloy composition, it being understood that trace amounts of incidental elements and/or impurities may find their way into the aluminium alloy.

In an embodiment the second aluminium alloy has a composition B further comprising about 0.1% to 1% of silver and wherein the first aluminium alloy has a composition A having less than about 0.1% silver. This has the advantage that alloy A does not only have a very low Li content to enable the initiation of casting an ingot, but it also avoids the purposive addition of the rather expensive alloying element silver. At that stage of the casting process there is no purposive role for the addition of silver and the bottom end of the cast ingot is being cropped after the end of the cast and recycled.

In an embodiment, safe to the difference in the Li content and optionally also in the silver content, the first aluminium alloy and the second aluminium alloy have otherwise about the same chemical composition.

The method according to this invention is useful for lithium containing aluminium alloys having a Li-content in the range of at least about 0.2% Li, and preferably at least about 0.6%, and which may contain up to about 10% of Li, and preferably up to about 4%. In particular alloys of the 2XXX, 5XXX, 7XXX, and 8XXX-series families, such as, but not limited to, AA2050, AA2055, AA2060, AA2065, AA2076, AA2090, AA2094, AA2095, AA2195, AA2097, AA2197, AA2297, AA2397, AA2098, AA2198, AA2099, AA2199, AA8024, AA8090, AA8091, AA8093, can be produced.

The invention is not limited to the embodiments described before, which may be varied widely within the scope of the invention as defined by the appending claims.

The invention claimed is:

1. A method of casting an ingot of an aluminium alloy comprising lithium, the ingot having a length L, width W, and thickness T, the method comprising the steps of:

(a) preparing at least two molten aluminium based alloys in separate furnaces, a first alloy with a composition A which is free from lithium as purposive alloying element, and a second alloy with a composition B which comprises lithium as purposive alloying element;

(b) transferring the first alloy via a metal conveying trough from a first of said furnaces to a casting station;

(c) initiating the start of casting an ingot and casting the first alloy to a required length L1 of an ingot in the casting direction;

(d) subsequently transferring the second alloy via a metal conveying trough from a second of said furnaces to the casting station while simultaneously stopping the transfer of the first alloy to said casting station;

(e) casting the second alloy from an end surface of the cast first alloy at length L1 to an additional required length L2 in the casting direction;

(f) cropping the cast ingot at a bottom thereof at a length that is greater than or equal to the cast length L1.

2. The method according to claim 1, wherein said step (c) comprises direct chill casting in a vertical direction.

3. The method according to claim 1, wherein the cast length L1 is less than three times the thickness T of the cast ingot.

4. The method according to claim 1, wherein the metal conveying trough comprises a housing for a metal filter.

5. The method according to claim 1, wherein the metal conveying trough comprises a container for a metal degassing unit.

6. The method according to claim 1, wherein a transition between alloys A and B is obtained with no interruption to molten metal flow.

7. The method according to claim 1, wherein following casting length L2 in the casting direction of the second alloy, subsequently transferring the first alloy via the metal conveying trough from the first of said furnaces to the casting station while simultaneously stopping the transfer of the second alloy to said casting station, and casting the first alloy from an end surface of the second alloy at length L2 to an additional required length L3 in the casting direction and subsequently finishing the casting operation.

8. The method according to claim 1, wherein the first aluminium alloy has a composition A comprising less than 0.1% of lithium.

9. The method according to claim 1, wherein the second aluminium alloy has a composition B comprising 0.2% to 10% of lithium.

10. The method according to claim 9, wherein the first aluminium alloy has a composition A comprising less than 0.1% of lithium, wherein the second aluminium alloy has a composition B further comprising 0.1% to 1% of silver and wherein the first aluminium alloy has a composition A having less than 0.1% silver.

11. The method according to claim 1, wherein the second aluminium alloy has a composition B further comprising 0.1% to 1% of silver and wherein the first aluminium alloy has a composition A having less than 0.1% silver.

12. The method according to claim 1, wherein L1+L2 is equal to the length L of the cast ingot.

13. The method according to claim 1, wherein the cast length L1 is less than 2.5 times the thickness T of the ingot.

14. The method according to claim 1, wherein the metal conveying trough comprises a housing for a ceramic foam filter.

15. The method according to claim 1, wherein the first aluminium alloy has a composition A which is substantially lithium free.

* * * * *